United States Patent [19]

Reinehr et al.

[11] 4,224,269

[45] Sep. 23, 1980

[54] PROCESS FOR SPINNING HYGROSCOPIC FILAMENTS AND FIBERS

[75] Inventors: Ulrich Reinehr; Toni Herbertz, both of Dormagen; Hermann-Josef Jungverdorben, Grevenbroich, all of Fed. Rep. of Germany

[73] Assignee: Bayer Aktiengesellschaft, Leverkusen, Fed. Rep. of Germany

[21] Appl. No.: 887,212

[22] Filed: Mar. 16, 1978

[30] Foreign Application Priority Data

Mar. 26, 1977 [DE] Fed. Rep. of Germany ..... 2713456

[51] Int. Cl.[2] ..... D01F 6/18; B29F 3/10

[52] U.S. Cl. ..... 264/171; 264/205; 264/206; 428/373; 428/376

[58] Field of Search ..... 264/206, 205, 207, 83, 264/171, 41; 428/373, 376

[56] References Cited

U.S. PATENT DOCUMENTS

| | | | |
|---|---|---|---|
| 1,838,121 | 12/1931 | Veles | 264/207 |
| 2,032,606 | 3/1936 | Whitehead | 264/207 |
| 2,425,782 | 8/1947 | Bludworth et al. | 264/203 |
| 2,688,010 | 8/1954 | Chaney | 264/203 |
| 2,876,494 | 3/1959 | Janssen et al. | 264/207 |
| 3,415,922 | 12/1968 | Carter et al. | 264/205 |
| 3,828,014 | 8/1974 | Weeden et al. | 264/206 |
| 3,873,508 | 3/1975 | Turner | 264/206 |

FOREIGN PATENT DOCUMENTS

| | | | |
|---|---|---|---|
| 056662 | 3/1954 | France | 264/202 |

*Primary Examiner*—Jay H. Woo

*Attorney, Agent, or Firm*—Sprung, Felfe, Horn, Lynch & Kramer

[57] ABSTRACT

The invention relates to a process for the production of hygroscopic filaments or fibers by dry-spinning a polymer solution wherein immediately they issue from the spinning jet or at the latest at a time when their solidification is still not complete, the filaments are brought into contact with water-vapour or with the vapour of another liquid which coagulates filaments.

12 Claims, No Drawings

PROCESS FOR SPINNING HYGROSCOPIC FILAMENTS AND FIBERS

This invention provides a process for the production of hygroscopic fibres and filaments, and more particularly provides a process for the production of hydrophilic fibres and filaments from filament-forming synthetic polymers by dry-spinning polymer solution.

It has already been proposed to produce hygroscopic filaments and fibres from filament-forming synthetic polymers by adding to the spinning solvent from 5 to 50% by weight, based on solvent and solids, of a substance which is essentially a non-solvent for the polymer, which has a higher boiling point than the solvent used and which is readily miscible both with the spinning solvent and with a liquid suitable for washing the filaments, and subsequently washing this non-solvent out of the filaments produced. Preferred non-solvents in this process are polyhydric alcohols such as glycerol, sugar, and glycols.

Fibres such as these spun from acrylonitrile polymers for example have a core-jacket structure and a water retention capacity of at least 10%. The higher the proportion by weight of non-solvent added, the greater the extent to which the filaments are hygroscopic.

It has now surprisingly been found that hygroscopic filaments and fibres of the type in question can also be obtained, if, before their solidification, the filaments are brought into contact with water vapour or with the vapour of another liquid which coagulates the filaments, and are thus solidified.

Accordingly, the present invention provides in one aspect a process for the production of hygroscopic filaments and fibres from filament-forming synthetic polymers by dry spinning a polymer solution, wherein immediately they issue from the spinning jet, or at the latest at a time when their solidification is not yet complete, the filaments are brought onto contact either with water vapour or with the vapour of another liquid which is capable of coagulating the filaments.

The polymers spun by the process according to the present invention are polymers which are not normally hydrophilic, and are preferably acrylonitrile polymers or more preferably, acrylonitrile polymers containing at least 50% by weight, especially at least 85% by weight, of acrylonitrile units.

The process according to the present invention may also be used for the production of two-component or modacrylic fibres, fibres of homopolymers, spin-dyed fibres and also fibres of polymers blends, for example mixtures of acrylonitrile polymers and polycarbonates. It is also possible in accordance with the present invention to use linear, aromatic polyamides such as, for example, the polyamide of m-phenylene diamine and isophthalic acid, or polyamides which may also contain heterocyclic ring systems such as, for example, benzimidazoles, oxazoles or thiazoles and which can be produced by dry spinning from a spinning solution with a solvent to be evaporated.

Other suitable compounds are polymers having melting points above 300° C. which, in general, can no longer be spun from the melt and which are produced by a solution spinning process, for example by dry spinning.

The spinning process is in principle a conventional dry spinning process, preferably from strongly polar organic solvents, such as dimethyl formamide, dimethyl acetamide and dimethyl sulphoxide. However, it is also possible to spin mixtures of polymers, spinning solvents and non-solvents for the polymer such as for example, water, polyhydric alcohols and glycols which can be mixed with the spinning solvent to form a solution.

In addition to water vapour, vapours which may be used in accordance with the invention for coagulating the unsolidified filaments are any vapours of substances which represent a non-solvent for the spun polymers, particularly acrylonitrile polymers, such as for example, in the case of acrylonitrile polymers, monosubstituted and polysubstituted alkyl ethers and esters of polyhydric alcohols, such as diethylene glycol, triethylene glycol, tripropylene glycol, triethylene glycol diacetate, tetraethylene glycol and glycol ether acetates. Alcohols, such as 2-ethyl cyclohexanole, glycerol, esters or ketones, or mixtures, for example of ethylene glycol acetates, are also suitable. In addition to water, particularly preferred substances are those which can readily be evaporated, have a high flash point and are substantially non-inflammable, for example methylene chloride and carbon tetrachloride.

Depending upon the point at which, and the intensity with which, the vapour is blown onto the polymer filaments, and also upon the thermal conditions prevailing in the spinning duct, it is possible to control both the cross-sectional structure and the width of the jacket, and also the hygroscopicity of the filaments. It has been found that core-jacket fibres having substantially round to circular cross-sectional forms, a very thin jacket occupying at most 25% of the total cross-sectional area and an extremely high water retention capacity of 60% and higher are always obtained when spinning is carried out at low duct temperatures of at most 140° C., preferably in the range from 20° to 120° C. (cf. Table 1, Nos. 1 to 3).

At higher duct temperatures, preferably above 160° C., the core-jacket fibres obtained have substantially oval to trilobal cross-sectional forms water retention values of from about 20 to 60%, the jacket area contributing up to about 60% of the total cross-sectional area.

The thickness and, hence, the border width of the jacket area can be controlled by selecting the ratio of air to vapour mixture in such a way that, with large quantities of vapour and small quantities of air, core-jacket fibres with a large border width of the jacket area, which can contribute up to 75% of the total cross-sectional area of the fibre, are preferably obtained (cf. Table 1, No. 21).

If, by contrast, only a little steam by comparison with the amount of air is used in the spinning process, the core-jacket fibres obtained increasingly approximate the dumbbell from characteristic of dry spun fibres and have a correspondingly low water retention capacity (cf. Table 1, Nos. 5 and 6).

The cross-sectional structure of the core-jacket fibres was determined from photographs taken with an electron microscope. For determining the core and jacket components of the fibres, approximately 100 fibre cross-sections are evaluated by quantitative analysis with the "Classimat" image analyser manufactured by the Leitz company.

In the process according to the present invention, the vapour is preferably blown in above the spinning jet, in the direction of the air stream and the filament take-off path. However, the vapour can also be blown on transversely to the filaments below the spinning jet providing no excessive turbulence is generated.

In order to avoid excessive condensation of water vapour and solvent mixtures in the spinning duct, a duct temperature of more than 100° C. and preferably from 105° to 140° C. has proved to be optimal for the shortest possible duct lengths, for example 1 meter. As previously mentioned, the jacket width and porosity of the filaments can be controlled according to the intensity with which the vapour is blown in, i.e. it is readily possible in this way to determine the degree of lustre and the dyeability of the spun filaments as required for their subsequent applications.

In principle, the non-solvent vapours, preferably water vapour, more preferably saturated steam, may be allowed to act for as long as the filament material is not completely solidified.

Accordingly, the process according to the present invention, may also be carried out with advantage by exposing the bundle of filaments to the action of vapour by means of a jet or a tube immediately after they have left the spinning duct. Hygroscopic, porous core-jacket fibres are also formed in this case.

Vapour-air mixtures are preferably used for the vapour treatment in the process according to the present invention because they may be controlled by the temperature in such a way that no significant condensation occurs in the spinning duct. Where spinning is carried out in a pure vapour atmosphere, the filaments obtained have very little lustre whereas, by spinning in mixtures of vapour and air, it is possible to obtain high-lustre filaments with extremely good hygrscopic properties. However, the objects of the invention cannot be achieved with superheated steam.

The necessary quantities of vapour and air are, of course, determined by the particular dimensions of the spinning duct and by the particular process parameters, such as spinning rate, spinning temperature, duct temperature, and solution concentration, as well as by the required filament properties. These conditions may be adapted to one another for each individual case by corresponding preliminary tests.

Spinning with a spinning duct 600 cm long and 30 cm in diameter produced the following results:

If, during spinning, the quantity of air is reduced below a critical quantity, the gas volume present for small amounts of steam is so low that the polymer solution can no longer be spun. The lower spinnability limit lies at around 2 cubic meters of air per hour per kg of spinning material for a minimum quantity of vapour of 1 kg per hour (cf. Table 1, No. 22).

The minimum amount of water vapour blown in which is required to produce core-jacket fibres which are still hygroscopic amounts to approximately 1 kg per kg of spinning material at a duct temperature of 20° C. for a normal polyacrylonitrile spinning solution having a concentration of 30%.

If, however, a mixture of polymer, spinning solvent and non-solvent is used, even small quantities of vapour amounting to 0.1 kg per kg of spinning material are sufficient to considerably increase the water retention capacity of core-jacket fibres such as these (cf. Example III, b and c).

At higher duct temperatures, particularly above 160° C., a larger quantity of vapour, preferably about 10 kg of vapour per hour per kg of spinning material, is necessary.

If the vapour is applied to the filaments outside the spinning duct, for example through a nozzle, 5 kg of vapour per hour per kg of spinning material are generally sufficient for obtaining hygroscopic, porous core-jacket filaments.

The invention is further illustrated by the following non-limitative Examples, in which the parts and percentages quoted are based on weight, unless otherwise indicated.

EXAMPLE 1

An acrylonitrile copolymer of 93.6% of acrylonitrile, 5.7% of methacrylate and 0.7% of sodium methallyl sulphonate having a K-value of 81 was dissolved in dimethyl formamide (DMF) at 80° C. The filtered spinning solution, which had a final concentration of approximately 30% by weight, was dry spun from a 180-bore spinning jet. 25 kg/hour of saturated steam and 10 cubic meters/hour of air at 150° C. were blown into the spinning duct (length 600 cm, diameter 30 cm) above the spinning jet. The duct temperature was 140° C. Approximately 5.8 kg of vapour were consumed for every kg of spun material produced. The filaments had a DMF-content of 59%, based on polymer solids. The filaments having an overall denier of 2400 dtex were collected on bobbins and combined to form tow having a denier of 68,400 dtex. The tow was then drawn in a ratio of 1:4.0 in boiling water, washed, provided with an antistatic preparation, dried at 120° C. with 20% permitted shrinkage, and crimped and cut into 60 mm long staple fibres. The individual fibres with a final denier of 3.3 dtex had a water retention capacity according to DIN 53814 of 63%. The fibres had a pronounced core-jacket structure with an oval cross-sectional form.

The jacket area contributed approximately 45% of the total cross-sectional area.

Further Examples are summarised in Table 1 below. The spinning solution were spun into core-jacket fibres with a final denier of 3.3 dtex and aftertreated in the same way as described in Example 1. The quantities of vapour and air, the duct temperature and the air temperature were all varied during the spinning process. The polymer described above was used as the solid.

TABLE I

| No. | Quantity of vapour in kg per kg of spinning material | Quantity of air (cubic meters/hour) | Air temp. °C. | Duct temp. °C. | Appearance (visual assessment) | Cross-sectional form | Percentage contribution of jacket area to the total cross-sectional area | DMF-content Spun material % | WR (according to DIN 53814 in %) |
|---|---|---|---|---|---|---|---|---|---|
| 1 | 2.8 | 10 | 150 | 20 | dull | circular | 8 | 79 | 118 |
| 2 | 2.8 | 10 | 150 | 100 | dull | circular | 12 | 59 | 77 |
| 3 | 2.8 | 10 | 150 | 120 | dull | circular | 25 | 56 | 65 |
| 4 | 2.8 | 10 | 150 | 140 | lustrous | oval | 35 | 41 | 59 |

TABLE I-continued

| No. | Quantity of vapour in kg per kg of spinning material | Quantity of air (cubic meters/hour) | Air temp. °C. | Duct temp. °C. | Appearance (visual assessment) | Cross-sectional form | Percentage contribution of jacket area to the total cross-sectional area | DMF-content Spun material % | WR (according to DIN 53814 in %) |
|---|---|---|---|---|---|---|---|---|---|
| 5 | 2.8 | 10 | 150 | 160 | lustrous | dumbbell | 70 | 33 | 12 |
| 6 | 2.8 | 10 | 150 | 200 | lustrous | dumbbell | 95 | 21 | 8 |
| 7 | 2.8 | 10 | 40 | 140 | lustrous to dull | round | 40 | 41 | 44 |
| 8 | 2.8 | 10 | 100 | 140 | lustrous | oval | 35 | 46 | 45 |
| 9 | 2.8 | 10 | 120 | 140 | lustrous | oval | 35 | 47 | 45 |
| 10 | 2.8 | 10 | 200 | 140 | lustrous | round to oval | 35 | 46 | 42 |
| 11 | 4.6 | — | — | 140 | dull | round | 65 | 48 | 48 |
| 12 | 4.6 | 5 | 150 | 140 | dull | oval to trilobal | 50 | 59 | 58 |
| 13 | 4.6 | 10 | 150 | 140 | lustrous | circular | 30 | 58 | 58 |
| 14 | 4.6 | 20 | 150 | 140 | lustrous | circular | 25 | 53 | 62 |
| 15 | 0.3 | 10 | 150 | 140 | lustrous | dumbbell | 1 | 31 | 4 |
| 16 | 0.7 | 10 | 150 | 140 | lustrous | dumbbell | 1 | 33 | 9 |
| 17 | 1.4 | 10 | 150 | 140 | lustrous | angular to trilobal | 20 | 56 | 61 |
| 18 | 2.8 | 10 | 150 | 140 | lustrous | oval | 35 | 41 | 59 |
| 19 | 5.6 | 10 | 150 | 140 | lustrous to dull | circular | 40 | 43 | 65 |
| 20 | 8.6 | 10 | 150 | 140 | dull | circular | 60 | 64 | 72 |
| 21 | 13.8 | 10 | 150 | 140 | dull | circular | 75 | 73 | 69 |
| 22 | 0.7 | 2 | 150 | 140 | no solidification | | | | |

As can be seen from the Table, there are distinct relationships between the cross-sectional form, the jacket width, the water retention capacity and appearance of the porous core-jacket fibres.

*Dull* highly hygroscopic fibres with generally a circular cross-section and a thin jacket area contributing less than 30% of the total cross-sectional area are obtained at duct temperatures below 140° C., preferably in the range from 20° to 120° C. (Nos. 1 to 3). The water retention capacity decreases considerably with increasing duct temperatures, the filaments become lustrous and also change into the dumbbell form at around 160° C. (Nos. 4 to 6).

In addition, dull filaments with substantially round cross-sections, but with increased jacket widths contributing upwards of around 40% of the total cross-sectional area are formed with small quantities of air and at low air temperatures (Nos. 12 and 7), with large quantities of vapour upwards of around 5 kg of vapour per kg of spun material (Nos. 19 to 21) and where spinning is carried out in a pure vapour atmosphere (No. 11).

*Lustrous* fibres with water retention values of more than 10% are preferably obtained at duct temperatures above 120° C. (Nos. 4 and 5), at air temperatures upwards of 100° C. (Nos. 8 to 10), with quantities of air in excess of 5 cubic meters per hour, preferably upwards of 10 cubic meters (Nos. 13 and 14) and with quantities of vapour below 5 kg of vapour per kg of spun material (Nos. 17 and 18).

As can be seen in Examples 15 and 16 in Table I, the fibres obtained with quantities of vapour below 1 kg per kg of spun material show inadequate hygroscopic properties. The fibres have the dumbbell form typical of dry spun fibres.

EXAMPLE 2

64 kg of dimethyl formamide were mixed with 4 kg of water at room temperature in a vessel. 32 kg of an acrylonitrile copolymer with the same chemical composition as in Example 1 were then added with stirring. The suspension which had a polymer solids content of 32% by weight was delivered by a gear pump to a heating vessel and heated to 130° C. The residence time in the heating vessel was 3 minutes. The spinning solution was then filtered and delivered directly to a 380-bore spinning jet. 10 kg/hour of saturated steam and 40 cubic meters/hour of air at 120° C. were blown into the spinning duct above the spinning jet. The duct temperature was 140° C. Approximately 1.75 kg of steam were assumed for every kg of spun material produced. The filaments had a DMF content of 51%, based on polymer solids. The filaments having an overall denier of 3800 dtex were collected on bobbins, combined to form a tow having a denier of 478,800 dtex and aftertreated in the same way as described in Example 1 to form fibres having a final denier of 3.3 dtex. The fibres had a water retention capacity of 33%. They had a pronounced core-jacket structure with a bean-shaped to trilobal cross-sectional form. The jacket area contributed approximately 15% of the total cross-sectional area.

EXAMPLE 3

(a) 60 kg of DMF were mixed with 10 kg of glycerol at room temperature in a vessel. 30 kg of an acrylonitrile copolymer with the same chemical composition as in Example 1 were then added with stirring. As in Example 1, the suspension was dissolved, filtered and dry spun under similar steam and air conditions from a 380-bore spinning jet. Approximately 1.9 kg of steam were consumed per kg of spun material produced. The filaments had a DMF content of 54%, based on polymer solids. The filaments having an overall denier of 3560 dtex were again doubled to form a tow and aftertreated in the same way as in Example 1 to form fibres having a final denier of 3.3 dtex. The fibres had a water retention capacity of 74%. They had a pronounced core-jacket structure with an oval to bean-shaped cross-sectional form. The jacket area contributed approximately 20% of the total cross-sectional area.

(b) 0.1 kg of steam per kg of spinning material was blown in the spinning direction onto part of the spinning solution as it issued from the spinning jet. The filaments having an overall denier of 3560 dtex were again aftertreated in the same way to form fibres having a final denier of 3.3 dtex. The fibres had a water retention capacity of 36%.

EXAMPLE 4

60 kg of DMF were mixed with 5 kg of tripropylene glycol at room temperature in a vessel. 35 kg of an acrylonitrile copolymer with the same chemical composition as in Example 1 were then added with stirring, after which the suspension dissolved, filtered and dry spun from a 72-bore spinning jet in the same way as described in Example 2. 12 kg/hour of methylene chloride vapours and 10 cubic meters/hour of air at 40° C. were blown into the spinning duct above the spinning jet. The duct temperature was 24° C. Approximately 6.2 kg of methylene chloride vapour was consumed per kg of spun material produced. The filaments had a DMF content of 76%, based on polymer solids. The filaments having an overall denier of 1620 dtex were again collected on bobbins, doubled and aftertreated in the same way as described in Example 1 to form fibres having a final denier of 6.7 dtex. The fibres had a water retention capacity of 102%. They had a pronounced core-jacket structure with a circular cross-sectional form. The jacket area contributed approximately 5% of the total cross-sectional area.

EXAMPLE 5

A spinning solution of an acrylonitrile copolymer with the same composition and concentration as described in Example 1 was dry spun from a 180-bore spinning jet. 20 cubic meters/hour of air at 50° C. were blown in. The duct temperature was 120° C. The filaments had a DMF-content of 41%, based on polymer solids. Immediately on issuing from the spinning duct, the filaments having an overall denier of 2400 dtex were sprayed with 60 kg/hour of saturated steam from a nozzle in the filament take-off direction. The nozzle was accomodated in a box with an outlet for the condensate. The consumption of steam amounted to approximately 13.9 kg of steam per kg of spun material produced. The filaments were then collected on bobbins, doubled to form a tow with an overall denier of 684,000 and aftertreated in the same way as described in Example 1 to form fibres having a final denier of 3.3 dtex. The fibres had a water retention capacity of 34%. They had a core-jacket structure with a bean-shaped to oval cross-sectional form. The jacket area contributed approximately 20% of the total cross-sectional area.

EXAMPLE 6

(a) A spinning solution of an acrylonitrile copolymer having the same composition and concentration as in Example 2 was dry spun from a 380-bore spinning jet. 10 kg/hour of saturated steam, but no air, was blown into the spinning duct above the spinning jet. The duct temperature was 88° C. Approximately 1.7 kg of steam were consumed per kg of spun material produced. The filament had a DMF content of 46%, based on polymer solids. The filaments having an overall denier of 3800 dtex were collected on bobbins, doubled to form a tow and aftertreated in the same way as in Example 1 to form fibres having a final denier of 3.3 dtex. The filaments had a water retention capacity of 119%. Once again they had a core-jacket structure with an oval to round cross-sectional form. The jacket area contributed approximately 30% of the total cross-sectional areas. The fibres were extremely dull.

(b) A spinning solution with the same composition and concentration was similarly spun. Instead of 10 kg of saturated steam, 37 kg/hour of saturated steam was blown into the duct above the spinning jet. 6.5 kg of steam were used per kg of spun material produced. The filaments had a DMF content of 70%, based on polymer solids. The filaments were similarly aftertreated to form fibres having a final denier of 3.3 dtex. The fibres had a water retention capacity of 131%. Once again the fibres had a core-jacket structure with an oval to round cross-sectional form and were extremely dull. The jacket area contributed approximately 50% of the total cross-sectional area.

EXAMPLE 7

5.3 kg of an acrylonitrile copolymer of 93.6% of acrylonitrile, 5.7% of methyl acrylate and 0.7% of sodium methallyl sulphonate were dissolved in 13.6 kg of DMF at 90° C. In addition, 5.3 kg of a polymer mixture consisting of 4.5 kg of acrylonitrile homopolymer and 0.8 kg of an acrylonitrile copolymer of 91% of acrylonitrile, 5.6% of methylacrylate and 3.4% of sodium methyallyl sulphonate, were dissolved in 16.3 kg of DMF at 100° C. Both solutions were delivered to a bifilar jet in a ratio of 1:1 and spun side-by-side. 10 kg/hour of saturated steam and 10 cubic meters/hour of air at 150° C. were blown into the spinning duct above the spinning jet. The duct temperature was 140° C. Approximately 2.4 kg of steam were consumed per kg of spun material produced. The filaments were doubled to form a tow, drawn into a ratio of 1:3.6 in boiling water, washed, prepared, dried under tension at 110° C., crimped, cut and fixed in steam for 1.5 minutes. The fibres, which had an individual denier of 3.3 dtex, showed a water retention capacity of 54%. They had a pronounced core-jacket structure with a mushroom-like cross-section. The jacket area contributed approximately 50% of the total cross-sectional area. The fibres contained approximately 11 crimp arcs per cm and a crimp contraction of 10.2%. The crimp was permanent and remained substantially intact on treatment with water at boiling temperature.

EXAMPLE 8

(a) Part of the spinning solution of Example 6 was spun at a duct temperature of 200° C. instead of 88° C. under otherwise the same conditions and aftertreated to form fibres with a final denier of 3.3 dtex. The fibres had a water-retention capacity of 24%. Once again they had a core-jacket structure with a trilobal to T-shaped cross-sectional form. The jacket area contributed less than 5% of the total cross-sectional area.

(b) When spinning was carried out at a duct temperature of 140° C. under otherwise the same conditions, core jacket fibres with an oval to trilobal cross-sectional form were obtained. The jacket area contributed approximately 30% of the total cross-sectional area and the fibres had a water retention capacity of 49%.

We claim:

1. A process for producing hygroscopic filaments or fibers of an acrylonitrile polymer, the said filaments or fibers having a core-jacket structure in cross-section; the process comprising dry spinning a solution of an acrylonitrile polymer and, at a time after the filament or fiber has issued from the spinning jet and before the filament or fiber has completely solidified, subjecting the filament or fiber to water vapor or the vapor of a liquid other than water which coagulates the filament or fiber.

2. The process of claim 1 in which the vapor is blown from above the spinning jet in the direction or filament or fiber travel.

3. The process of claim 1, wherein said acrylonitrile polymer consists of at least 50% by weight of acrylonitrile units.

4. The process of claim 1, in which the filament is subjected to water vapor which is steam.

5. The process of claim 4, in which the steam is non-superheated.

6. The process of claim 1 in which spinning is conducted into a spinning duct which is at a temperature of more than 100° C.

7. The process of claim 6, in which spinning is conducted into a spinning duct which is at a temperature of over 100° C. to 140° C.

8. The process of claim 1, in which the air temperature in spinning is 40° C. to 200° C.

9. The process of claim 6 wherein at least one kilogram steam is admitted into said spinning duct per kilogram of material to be spun.

10. The process of claim 9 wherein there is admitted into the spinning duct air in an amount of at least 2 cubic meters of air per hour per kilogram of material to be spun.

11. A process according to claim 1 wherein the solution of acrylonitrile polymer includes a non-solvent of said acrylonitrile polymer which is miscible with the solvent of said solution and into the spinning duct into which said solution of acrylonitrile polymer is spun there is introduced a quantity of said vapor in an amount of 0.1 kilogram per kilogram of material to be spun.

12. A process according to claim 1 wherein the material to be spun is spun into a spinning duct maintained at a temperature above 160° C. and into said spinning duct there is injected an amount of vapor equivalent to at least 10 kilograms of vapor per hour per kilogram of material to be spun.

* * * * *

UNITED STATES PATENT AND TRADEMARK OFFICE

CERTIFICATE OF CORRECTION

PATENT NO. : 4,224,269

DATED : September 23, 1980

INVENTOR(S) : ULRICH REINEHR, TONI HERBERTZ, and HERMANN-JOSEF JUNGVERDORBEN

It is certified that error appears in the above—identified patent and that said Letters Patent is hereby corrected as shown below:

Column 9, line 10, "or" should be --of--

Signed and Sealed this

*Twenty-fourth* Day of *February 1981*

[SEAL]

*Attest:*

RENE D. TEGTMEYER

*Attesting Officer*

*Acting Commissioner of Patents and Trademarks*